US010859041B2

(12) United States Patent
Hong et al.

(10) Patent No.: US 10,859,041 B2
(45) Date of Patent: Dec. 8, 2020

(54) INTAKE MANIFOLD

(71) Applicants: Hyundai Motor Company, Seoul (KR); Kia Motors Corporation, Seoul (KR)

(72) Inventors: Seungwoo Hong, Seoul (KR); Dong Ho Chu, Yongin-si (KR); Dong Hee Han, Seoul (KR); Sangwook Kweon, Incheon (KR); Gil Hyun Ahn, Hwaseong-si (KR); Kwanhee Lee, Suwon-si (KR); Heechang Oh, Suwon-si (KR); Yeongseop Park, Seoul (KR); Jaegu Kang, Seoul (KR); Sung Bong Park, Seoul (KR); Dongjin Kang, Suwon-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 0 days.

(21) Appl. No.: 16/437,795

(22) Filed: Jun. 11, 2019

(65) Prior Publication Data

US 2020/0182203 A1 Jun. 11, 2020

(30) Foreign Application Priority Data

Dec. 7, 2018 (KR) ..... 10-2018-0157513

(51) Int. Cl.

| | |
|---|---|
| ***F02M 26/43*** | (2016.01) |
| ***F02M 26/14*** | (2016.01) |
| ***F02M 35/104*** | (2006.01) |
| ***F02B 75/18*** | (2006.01) |
| ***F02M 26/17*** | (2016.01) |
| ***F02M 35/10*** | (2006.01) |
| ***F02D 17/02*** | (2006.01) |

(52) U.S. Cl.

CPC ..... *F02M 26/43* (2016.02); *F02B 75/18* (2013.01); *F02M 26/14* (2016.02); *F02M 26/17* (2016.02); *F02M 35/104* (2013.01); *F02M 35/10295* (2013.01); *F02B 2075/1816* (2013.01); *F02D 17/02* (2013.01)

(58) Field of Classification Search

CPC ..... F02M 26/43; F02M 26/14; F02M 35/104; F02M 26/17; F02M 35/10295; F02B 75/18; F02B 2075/1816; F02D 17/02

See application file for complete search history.

(56) References Cited

U.S. PATENT DOCUMENTS 4,459,960 A * 7/1984 Ueno ..... F02D 17/02 123/198 F 5,090,202 A * 2/1992 Hitomi ..... F02B 33/446 606/2

(Continued)

*Primary Examiner* — Brandon D Lee

(74) *Attorney, Agent, or Firm* — Slater Matsil, LLP

(57) ABSTRACT

An intake manifold according to an exemplary embodiment of the present invention may include a first intake manifold having a second intake pipe, a third intake pipe, and a first surge tank which temporarily stores intake air flowing through an intake line and distributes the intake air to the second intake pipe and the third intake pipe. A second intake manifold has a first intake pipe, a fourth intake pipe, and a second surge tank which temporarily stores intake air flowing through the intake line and distributes the intake air to the first intake pipe and the fourth intake pipe.

20 Claims, 8 Drawing Sheets

(56) References Cited

U.S. PATENT DOCUMENTS

2014/0238017 A1* 8/2014 Kim ..... B60T 17/02
60/624
2014/0366838 A1* 12/2014 Kim ..... F02M 35/10131
123/319
2016/0333801 A1* 11/2016 Tsukahara ..... F02D 41/0002

* cited by examiner

INTAKE MANIFOLD

CROSS-REFERENCE TO RELATED APPLICATIONS

This application claims priority to Korean Patent Application No. 10-2018-0157513, filed in the Korean Intellectual Property Office on Dec. 7, 2018, which application is hereby incorporated herein by reference.

TECHNICAL FIELD

The present invention relates to an intake manifold.

BACKGROUND

Generally, an internal combustion engine generates power by supplying fuel and air to a cylinder and combusting the fuel and air in the cylinder. When air is sucked, an intake valve is operated by driving of a camshaft, and air is sucked into the cylinder while the intake valve is open. In addition, the exhaust valve is operated by the driving of the camshaft, and the air is exhausted from the cylinder while the exhaust valve is open.

By the way, an optimal operation of the intake valve/exhaust valve is changed in response to revolutions per minute (RPM) of an engine. That is, an appropriate lift or valve opening/closing time is changed in response to the RPM of the engine. As described above, in order to implement an appropriate valve operation in response to the RPM of the engine, a variable valve lift (VVL) apparatus for designing a shape of a cam driving the valve in plural or operating a valve at different lifts in response to the RPM of the engine has been researched.

A cylinder de-activation (hereinafter, CDA) apparatus similar to the VVL apparatus in concept generally refers to a technology of deactivating some of all the cylinders during braking or a cruise control. During the CDA operation, a supply of fuel to cylinders to be deactivated and an operation of intake/exhaust valves are stopped.

When some cylinders are deactivated by the CDA apparatus, a pumping loss of the cylinders to be deactivated should be minimized and a loss of air supplied to catalyst to maintain an efficiency of the catalyst should be minimized.

For this purpose, the related art has used a method for minimizing a pumping loss and an air flow into a catalyst by using a mechanical configuration that stops a driving of an intake valve and an exhaust valve.

According to the CDA apparatus of the related art, the mechanical configuration for stopping the driving of the intake valve and the exhaust valve are additionally required, and as a result, main components of an engine, such as a cylinder head, needs to be changed.

Since an additional actuator for controlling the intake/exhaust valves for each cylinder is required, the number of components may be increased and manufacturing cost of a vehicle may be increased.

In addition, due to the increase in the number of components, the failure possibility of each component is increased and it is difficult to diagnose the failure of each part.

The above information disclosed in this Background section is only for enhancement of understanding of the background of the invention and therefore it may contain information that does not form the prior art that is already known in this country to a person of ordinary skill in the art.

SUMMARY

The present invention relates to an intake manifold and, in particular embodiments, to an intake manifold applied to an engine system capable of implementing a cylinder deactivation effect without using a separate cylinder deactivation apparatus.

Embodiments of the present invention can provide an intake manifold applied to an engine system having advantages of implementing a CDA function without a separate mechanical configuration.

An intake manifold including according to an exemplary embodiment of the present invention can include a first intake manifold having the second intake pipe, the third intake pipe, and a first surge tank in which temporarily stores intake air flowing through an intake line and distributes the intake air to the second intake pipe and the third intake pipe. A second intake manifold has the first intake pipe, the fourth intake pipe, and a second surge tank in which temporarily stores intake air flowing through the intake line and distributes the intake air to the first intake pipe and the fourth intake pipe.

The intake manifold may further include a manifold connection valve provided between the first surge tank and the second surge tank, and selectively opening and closing a flow passage of the intake air flowing between the first surge tank and the second surge tank.

The manifold connection valve may include a valve body forming an intake passage through which the intake air flow and a flap disposed in the intake passage and selectively opening and closing the intake passage.

The intake manifold may further include a throttle body having a throttle valve that adjusts amount of intake air flowing into the first surge tank from the intake line; wherein the throttle body is mounted in an intake inlet formed in the first surge tank.

A recirculation connection hole connected with the recirculation line may be formed in the second surge tank.

An internal volume of the first surge tank may be greater than an internal volume of the second surge tank.

An engine system according to another exemplary embodiment of the present invention may include an engine sequentially provide with a first to fourth cylinder for generating a driving torque by burning fuel; an intake manifold having a first intake manifold which is connected with an intake line and distributes intake air to some cylinders of the first to fourth cylinder, and a second intake manifold which is connected with the first intake manifold and distributes the intake air to the remained cylinders of the first to fourth cylinder. An exhaust manifold has a first exhaust manifold which is connected with the some cylinders connected with the first intake manifold, and a second exhaust manifold which is connected with the remained cylinders connected with the second intake manifold. A recirculation line is branched off from the second exhaust manifold and merging into the second intake manifold. A recirculation inlet valve is disposed in a portion where the recirculation line and the second exhaust manifold are joined. The intake manifold includes first to fourth intake pipes connected with the first to fourth cylinder, respectively, the first intake manifold includes a second intake pipe connected with the second cylinder and a third intake pipe connected with the third cylinder. A first surge tank temporarily stores intake air flowing through the intake line and distributes the intake air to the second intake pipe and the third intake pipe. The second intake manifold includes a first intake pipe connected with the first cylinder, a fourth intake pipe connected with the fourth cylinder, and a second surge tank which temporarily stores intake air flowing through the first intake manifold and distributes the intake air to the first intake pipe and the fourth intake pipe.

The engine system may further include a manifold connection valve provided between the first surge tank and the second surge tank, and selectively opening and closing a flow passage of the intake air flowing between the first surge tank and the second surge tank.

The manifold connection valve may include a valve body forming an intake passage through which the intake air flow; and a flap disposed in the intake passage and selectively opening and closing the intake passage.

The engine system may further include a throttle body having a throttle valve that adjusts amount of intake air flowing into the first surge tank from the intake line; wherein the throttle body is mounted in an intake inlet formed in the first surge tank.

A recirculation connection hole connected with the recirculation line may be formed in the second surge tank.

An internal volume of the first surge tank may be greater than an internal volume of the second surge tank.

An engine system according to another exemplary embodiment of the present invention may include an engine sequentially provide with a first to fourth cylinder for generating a driving torque by burning fuel; an intake manifold having a first intake manifold which is connected with an intake line and distributes intake air to some cylinders of the first to fourth cylinder, and a second intake manifold which is connected with the first intake manifold and distributes the intake air to the remained cylinders of the first to fourth cylinder; an exhaust manifold having a first exhaust manifold which is connected with the some cylinders connected with the first intake manifold, and a second exhaust manifold which is connected with the remained cylinders connected with the second intake manifold; a recirculation line which is branched off from the second exhaust manifold and merging into the second intake manifold; a recirculation inlet valve disposed in a portion where the recirculation line and the second exhaust manifold are joined; a turbocharger including a turbine that is rotated by exhaust gas exhausted from the second exhaust manifold and a compressor that is installed on an intake line at an upstream of the first intake manifold and is rotated together with the turbine; and an electric supercharger that is disposed in the intake line between the first intake manifold, and the compressor and includes a motor and an electric compressor operated by the motor to supply compressed air to the cylinders wherein the intake manifold includes first to fourth intake pipes connected with the first to fourth cylinder, respectively, wherein the first intake manifold includes a second intake pipe connected with the second cylinder; a third intake pipe connected with the third cylinder; and a first surge tank which temporarily stores intake air flowing through the intake line and distributes the intake air to the second intake pipe and the third intake pipe, wherein the second intake manifold includes a first intake pipe connected with the first cylinder; a fourth intake pipe connected with the fourth cylinder; and a second surge tank which temporarily stores intake air flowing through the first intake manifold and distributes the intake air to the first intake pipe and the fourth intake pipe.

The engine system may further include a manifold connection valve provided between the first surge tank and the second surge tank, and selectively opening and closing a flow passage of the intake air flowing between the first surge tank and the second surge tank.

The manifold connection valve may include a valve body forming an intake passage through which the intake air flow; and a flap disposed in the intake passage and selectively opening and closing the intake passage.

The engine system may further include a throttle body having a throttle valve that adjusts amount of intake air flowing into the first surge tank from the intake line; wherein the throttle body is mounted in an intake inlet formed in the first surge tank.

A recirculation connection hole connected with the recirculation line may be formed in the second surge tank.

An internal volume of the first surge tank may be greater than an internal volume of the second surge tank.

According to the engine system according to an exemplary embodiment of the present invention, it is possible to reduce the number of components and save the manufacturing cost of the vehicle, by implementing the CDA function without the separate mechanical configuration.

BRIEF DESCRIPTION OF THE DRAWINGS

Since the accompanying drawings are provided only to describe exemplary embodiments of the present invention, it is not to be interpreted that the spirit of the present invention is limited to the accompanying drawings.

Figure 1:
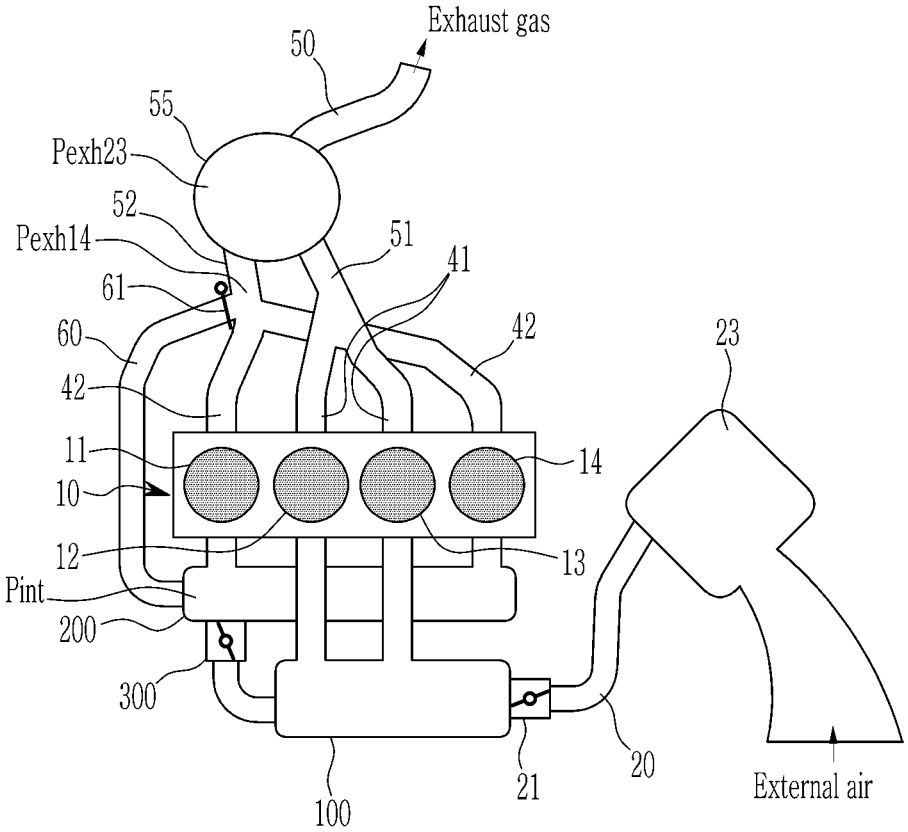
FIG. 1 is a schematic view illustrating an engine system according to an exemplary embodiment of the present invention.

The following reference numerals can be used in conjunction with the drawings:

10: engine
11, 12, 13, 14: cylinder
20: intake line
21: throttle valve
41: first exhaust manifold
42: second exhaust manifold
so: main exhaust line
51: first exhaust line
52: second exhaust line
55: catalytic converter
60: recirculation line
61: recirculation inlet valve
70: turbocharger
71: turbine
73: compressor
80: electric supercharger
81: motor
83: electric compressor
100: first intake manifold
112: second intake pipe
113: third intake pipe
120: inner mounting flange
121: inner engage hole

130: first surge tank
140: first intake inlet
150: first intake outlet
200: second intake manifold
211: first intake pipe
214: fourth intake pipe
220: outer mounting flange
221: outer engage hole
230: second surge tank
240: second intake inlet
250: recirculation connection hole
300: manifold connection valve
310: valve body
320: flap
330: intake passage

DETAILED DESCRIPTION OF ILLUSTRATIVE EMBODIMENTS

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention.

Accordingly, the drawings and description are to be regarded as illustrative in nature and not restrictive. Like reference numerals designate like elements throughout the specification.

Since sizes and thicknesses of the respective components were arbitrarily shown in the accompanying drawings for convenience of explanation, the present invention is not limited to contents shown in the accompanying drawings. In addition, thicknesses were exaggerated in order to obviously represent several portions and regions.

Hereinafter, an intake manifold according to an exemplary embodiment of the present invention will be described in detail with reference to accompanying drawings.

First and engine system to which the intake manifold is applied according to an exemplary embodiment of the present invention will be described in detail.

FIG. 1 is a schematic view illustrating an engine system according to an exemplary embodiment of the present invention.

As shown in FIG. 1, an engine system according to a first exemplary embodiment of the present invention includes an engine 10 that includes a plurality of cylinders 11, 12, 13, and 14 generating a driving torque by combusting fuel, a plurality of intake manifolds that distributes intake air into the cylinders 11, 12, 13, and 14, and a plurality of exhaust manifolds that collect exhaust gas from the cylinders 11, 12, 13, and 14 and exhaust the collected exhaust gas to the exhaust line.

The cylinders 11, 12, 13, and 14 of the engine 10 may be a four-cylindered engine including four cylinders. That is, the plurality of cylinders may include a first cylinder 11, a second cylinder 12, a third cylinder 13, and a fourth cylinder 14 that are sequentially disposed.

The plurality of intake manifolds may include a first intake manifold 100 and a second intake manifold 200. The first intake manifold 100 is connected with an intake line 20 in which external air flows to supply the external air to some of the plurality of cylinders 11, 12, 13, and 14. The second intake manifold 200 supplies external air to the other cylinders of the plurality of cylinders 11, 12, 13, and 14 through the first intake manifold 31.

In an exemplary embodiment of the present invention, the first intake manifold 100 supplies intake air to the second cylinder 12 and the third cylinder 13 and the second intake manifold 200 supplies intake air to the first cylinder 11 and the fourth cylinder 14.

An inlet of the first intake manifold 100 that is connected with the intake line 20 is provided with a throttle valve 21 that controls an intake flow rate, and the intake line 20 is provided with an air cleaner that cleans external air.

The plurality of exhaust manifolds may include a first exhaust manifold 41 and a second exhaust manifold 42. The first exhaust manifold 41 is connected with some cylinders that are connected with the first intake manifold 100. The second exhaust manifold 42 is connected with the other cylinders that are connected with the second intake manifold 200.

In the exemplary embodiment of the present invention, the first exhaust manifold 41 collects exhaust gas from the first cylinder 11 and the fourth cylinder 14 and exhausts the collected exhaust gas to the exhaust line, and the second exhaust manifold 42 collects exhaust gas from the second cylinder 12 and the third cylinder 13 and exhaust the collected exhaust gas to the exhaust line.

The engine system according to the first exemplary embodiment of the present invention includes a recirculation line 60 that is branched from the second exhaust manifold 42 to be joined to the second intake manifold 32.

A point at which the recirculation line 60 and the second exhaust manifold 42 are joined is provided with a recirculation inlet valve 61, and provided with a manifold connection valve 300 that is installed in the intake line 20 between the first intake manifold 100 and the second intake manifold 200.

The first exhaust line 51 connected with the first exhaust manifold 41 and the second exhaust line 52 connected with the second exhaust manifold 42 are joined to the main exhaust line 50. The main exhaust line 50 is provided with a catalytic converter 55 that purifying various noxious materials included in the exhaust gas.

The catalytic converter 55 may include a lean NOx trap (LNT) that purifies nitrogen oxide, a diesel oxidation catalyst, and a diesel particulate filter. Alternatively, the catalytic converter 55 may include a three way catalyst that purifies nitrogen oxide. The three way catalyst is a catalyst that simultaneously triggers a reaction of carbon monoxide, nitrogen oxide, and hydrocarbon compounds as noxious components of the exhaust gas to remove the carbon monoxide, the nitrogen oxide, and the hydrocarbon compounds, and mainly, Pd alone may be used and a Pt/Rh, Pd/Rh or Pt/Pd/Rh-based three way catalyst may be used.

Hereinafter, an intake manifold applied to the engine system according to an exemplary embodiment of the present invention will be described with reference to accompanying drawings.

Figure 2:
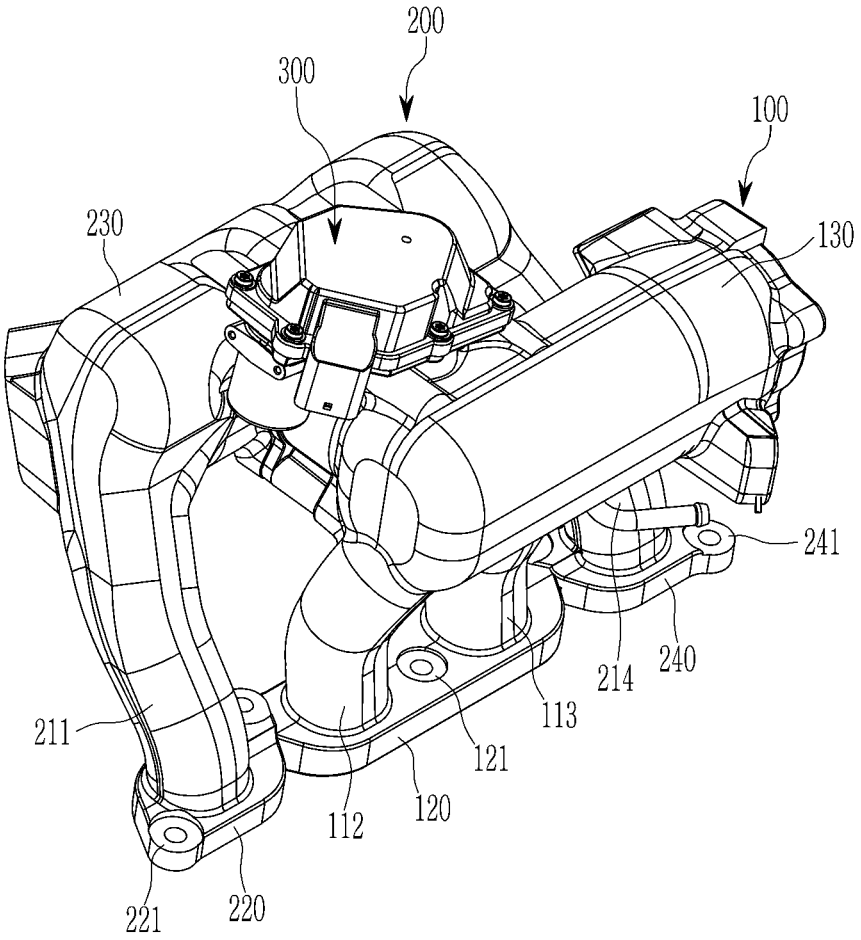
FIG. 2 is a perspective view illustrating an intake manifold applied to an engine system according to an exemplary embodiment of the present invention.
Figure 3:
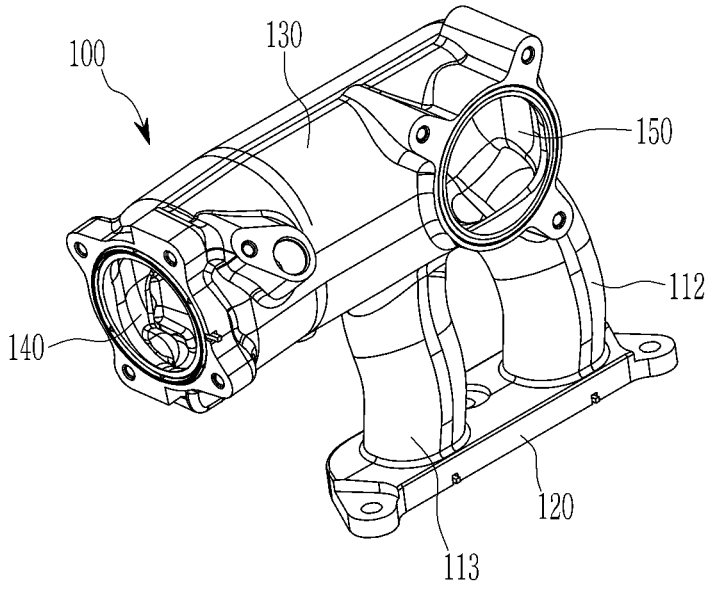
FIG. 3 is a perspective view illustrating a first intake manifold applied to an engine system according to an exemplary embodiment of the present invention.
Figure 4:
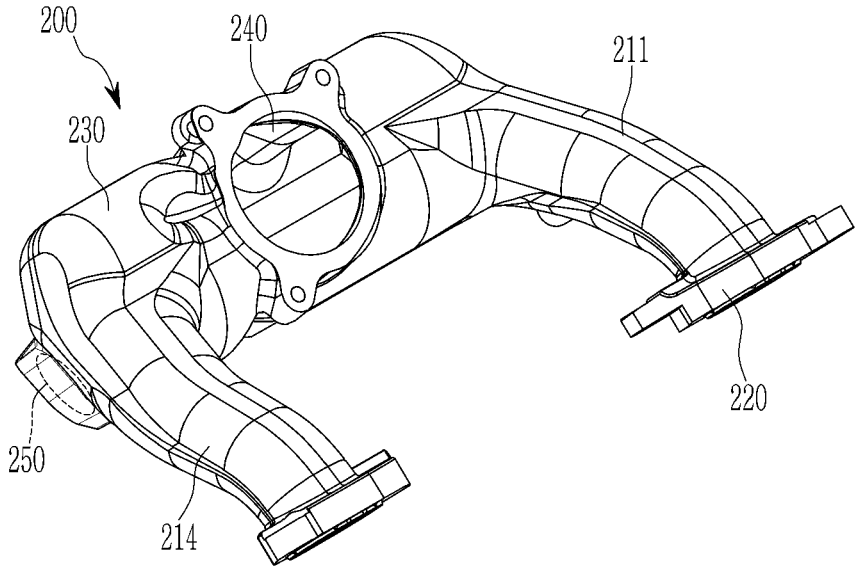
FIG. 4 is a perspective view illustrating a second intake manifold applied to an engine system according to an exemplary embodiment of the present invention.
Figure 5:
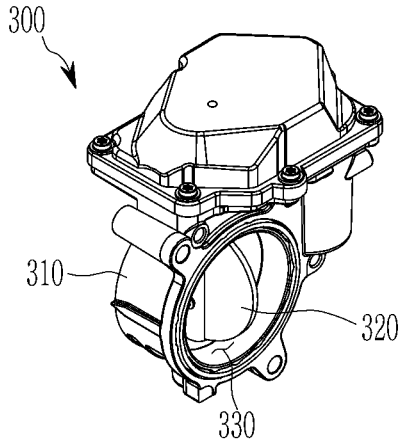
FIG. 5 is a perspective view illustrating a manifold connection valve applied to an engine system according to an exemplary embodiment of the present invention.

FIG. 2 is a perspective view illustrating an intake manifold applied to an engine system according to an exemplary embodiment of the present invention. FIG. 3 is a perspective view illustrating a first intake manifold applied to an engine system according to an exemplary embodiment of the present invention. FIG. 4 is a perspective view illustrating a second intake manifold applied to an engine system according to an exemplary embodiment of the present invention. And FIG. 5 is a perspective view illustrating a manifold connection valve applied to an engine system according to an exemplary embodiment of the present invention.

As shown in FIG. 2 to FIG. 5, intake manifold according to an exemplary embodiment of the present invention may include a first intake manifold 100 that distributes intake air flowing through intake line 20 to the second cylinder 12 and the third cylinder 13, and a second intake manifold 200 that distributes the intake air flowing through the first intake manifold 100 to the first cylinder 11 and the fourth cylinder 14. And the first to fourth cylinders are connected with a first to fourth intake pipes of the intake manifold, respectively.

The first intake manifold 100 may include the second intake pipe 112 connected with the second cylinder 12, the third intake pipe 113 connected with the third cylinder 13, and a first surge tank 130 temporarily storing intake air flowing through the second intake pipe 112 and the third intake pipe 113.

An inner mounting flange 120 is formed in an end portion of the second intake pipe 112 and the third intake pipe 113, and the first intake manifold 100 is assembled to a cylinder block forming the first to fourth cylinders through the inner mounting flange 120. At least one inner engage hole 121 is formed in the inner mounting flange 120 between the second intake pipe 112 and the third intake pipe 113.

The second intake manifold 200 may include the first intake pipe 211 connected with the first cylinder 11, the fourth intake pipe 214 connected with the fourth cylinder 14, and a second surge tank 230 distributing the intake air flowing though the first intake manifold 100 to the first intake pipe 211 and the fourth intake pipe 214.

Outer mounting flanges 220 are formed in end portions of the first intake pipe 211 and the fourth intake pipe 214, respectively. And the second intake manifold 200 is assembled to the cylinder block through the outer mounting flange 220. Outer engage holes 221 may be formed on both side of the outer mounting flange 220.

A manifold connection valve 300 is mounted between the first surge tank 130 and the second surge tank 230, and a flow passage of intake air flowing between the first surge tank 130 and the second surge tank 230 is selectively opened and closed by the manifold connection valve 300. The manifold connection valve may be operated by an ECU (engine control unit) provided in an vehicle.

For this, the manifold connection valve 300 connects with the first surge tank 130 and the second surge tank 230. The manifold connection valve 300 may include a valve body 310 in which an intake passage 330 of a cylinder shape is formed, and a flap 320 of a disk shape mounted in the intake passage 330. Intake air flows through the intake passage 330, and the intake passage 330 is selectively opened and closed by an operation of the flap 320. The intake passage 330 may be selectively opened and closed by a rotation of the flap 320. The flap 320 is rotated by a rotation of a rotation shaft connected with a drive motor, and operated by a control signal of the ECU.

A first intake inlet 140 is formed in one side of the first surge tank 130. A throttle body including a throttle valve for adjusting amount of intake air flowing through the intake line 20 is mounted at the first intake inlet 140. A first intake outlet 150 is formed in the other side of the first surge tank 130. The first intake outlet 150 is connected with the intake passage 330 of the manifold connection valve 300 and formed as a corresponding shape of the intake passage 330.

A second intake inlet 240 is formed in one side of the second surge tank 230. The second intake inlet 240 is connected with the intake passage 330 of the manifold connection valve 300, and is formed as a corresponding shape of the intake passage 330. A recirculation connection hole 250 is formed in the other side of the second surge tank 230, and is connected with a recirculation line.

Meanwhile, when some cylinders (e.g., first cylinder and fourth cylinder) are deactivated, since activated cylinders (e.g., second cylinder and third cylinder) need to supply enough external air, it is preferable that an internal volume of the first surge tank 130 is greater than an internal volume of the second surge tank 230.

Hereinafter, an operation of the engine system according to an exemplary embodiment of the present invention will be described in detail.

Figure 6:
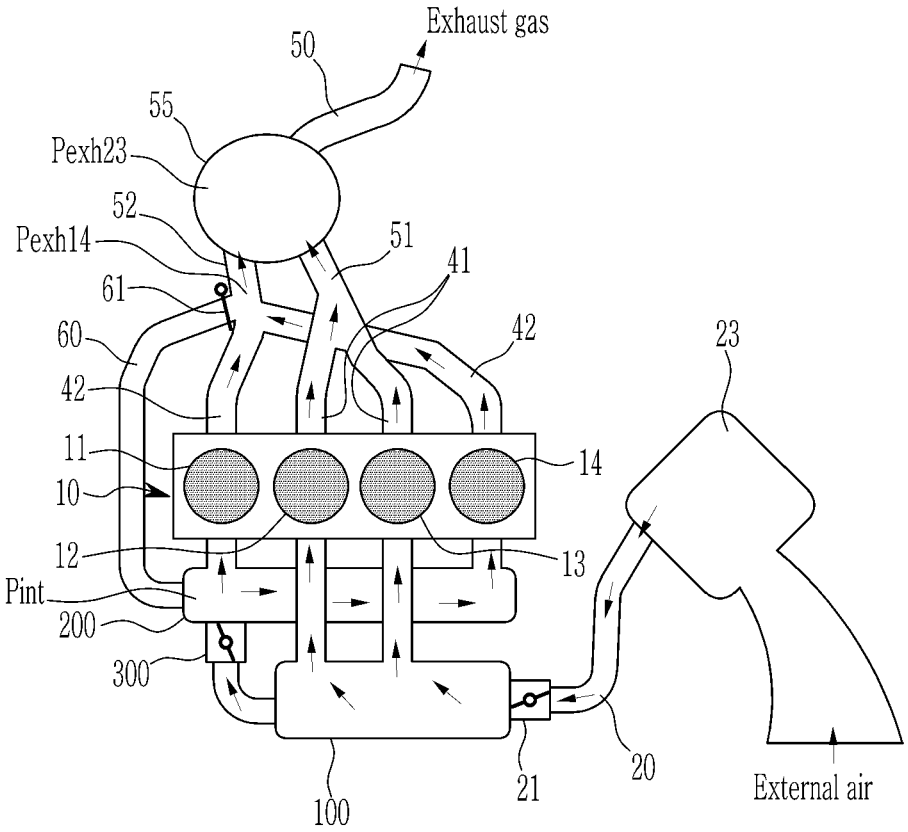
FIG. 6 and FIG. 7 are drawings illustrating an operation of an engine system according to a first exemplary embodiment of the present invention.

Referring to FIG. 6, the recirculation inlet valve 61 is closed, and the intake passage 330 is opened by an operation of the flap 320 of the manifold connection valve 300 when the engine 10 is normally operated, Accordingly, external air inflow from the intake line 20 to the first intake manifold 100 is supplied to the second cylinder 12 and the third cylinder 13. And external air inflow to the second intake manifold 200 through the first intake manifold 100 is supplied to the first cylinder 11 and the fourth cylinder 14.

During the combust process, the exhaust gas generated from the second cylinder 12 and the third cylinder 13 is collected at the first exhaust manifold 41 and exhausted to the outside through the first exhaust line 51 and the main exhaust line 50. The exhaust gas from the first cylinder 11 and the fourth cylinder 14 is collected at the second exhaust manifold 42 and exhausted to the outside through the second exhaust line 52 and the main exhaust line 50.

Figure 7:
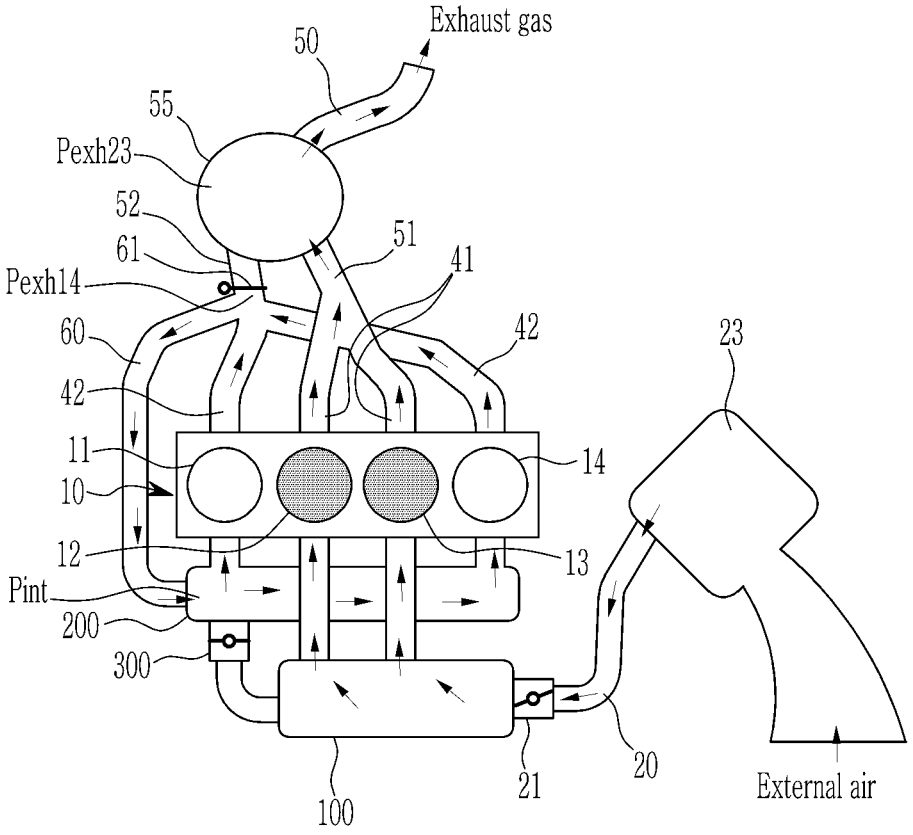

Referring to FIG. 7, if some cylinders of the engine 10 need to be deactivated, such as when the vehicle is traveling at low speed or coasting, the recirculation inlet valve 61 is opened and the manifold connection valve 300 is closed. And the fuel is not injected into the deactivated cylinders (e.g., first cylinder and fourth cylinder).

Accordingly, external air inflow to the first intake manifold 100 from the intake line 20 is supplied to the activated cylinders (e.g., second cylinder and third cylinder). And exhaust gas exhausted from the activated cylinders is collected at the first exhaust manifold 41 and exhausted to the outside through the first exhaust line 51 and the main exhaust line 50.

However, since the flap 320 of the manifold connection valve 300 operates to close the intake passage 330, the external air does not flow to the second intake manifold 200 through the first intake manifold 100, and the external air is supplies to the deactivated cylinders (e.g., first cylinder and fourth cylinder).

Further, since the intake passage 330 is closed by the flap 320 of the manifold connection valve 300 and the recirculation inlet valve 61 is opened, the second intake manifold 200 and the second exhaust manifold 42 are fluidly communicated, and all exhaust gas exhausted from the deactivated cylinders (e.g., first cylinder and fourth cylinder) is reflowed to the deactivated cylinders As such, since an intake system including the second intake manifold 200 and an exhaust system including the second exhaust manifold 42 are fluidly communicated with each other, an intake pressure Pint and an exhaust pressure Pexh14 of the first cylinder 11 and the fourth cylinder 14 to be deactivated almost coincide with each other. Accordingly, a pumping loss of the first cylinder 11 and the fourth cylinder 14 to be deactivated is minimized.

In addition, since an exhaust pressure Pexh23 of the activated second cylinder 12 and third cylinder 13 is larger than that of the deactivated first cylinder 11 and fourth cylinder 14 and the recirculation inlet valve 61 is open so that relatively low-temperature exhaust gas from the deactivated first cylinder 11 and fourth cylinder 14 is not exhausted to the exhaust gas cleaning device 55, it is possible to prevent a temperature of the catalyst of the exhaust gas cleaning device 55 from falling below an activation temperature and prevent an efficiency of the catalyst from deteriorating accordingly.

Hereinafter, an engine system according to a second exemplary embodiment of the present invention will be described in detail with reference to the accompanying drawings.

Figure 8:
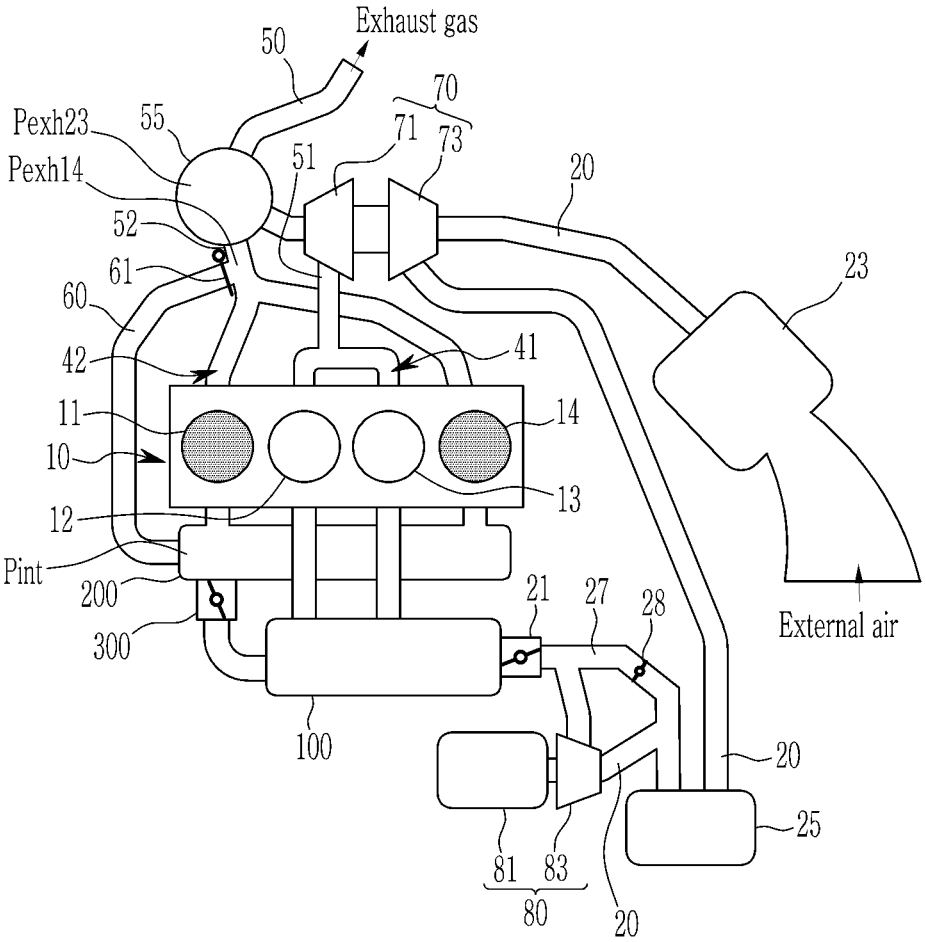
FIG. 8 is a schematic view illustrating an engine system according to a second exemplary embodiment of the present invention.

FIG. 8 is a schematic view illustrating an engine system according to a second exemplary embodiment of the present invention.

A basic configuration of the engine system according to the second exemplary embodiment of the present invention illustrated in FIG. 8 is fundamentally the same as the engine system as described above. However, the engine system according to the second exemplary embodiment of the present invention is different from the engine system according to the first exemplary embodiment of the present invention in that it further includes a turbocharger 70 and an electric supercharger 80 that supply charge air to the cylinders 11, 12, 13, and 14 of the engine. Hereinafter, for convenience of explanation, the same components will not be described, and only different components will be described.

The engine system according to the second exemplary embodiment of the present invention may further include the turbocharger 70 and the electric supercharger 80 that supply charge air (compressed air) to the cylinder of the engine 10.

The turbocharger 70 includes a turbine that is installed in the first exhaust line 51 to rotate by exhaust gas and a compressor 73 that is installed on the intake line 20 at an upstream of the first intake manifold 31 and rotates by interlocking to the turbine 71.

The electric supercharger 80 is installed in the intake line 20 in which the external air flows and includes a motor 81 and an electric compressor 83 that is operated by the motor 81.

The intake line 20 is installed on a bypass line that bypasses some air supplied to the electric supercharger 80, and the bypass line is provided with a bypass valve. An intake amount bypassing the electric supercharger 80 is controlled by an opening of the bypass valve.

As described above, the engine system according to the second exemplary embodiment of the present invention may supply the charge air to the cylinders 11, 12, 13, and 14 of the engine 10 through the turbocharger 70 and the electric supercharger 80, thereby expanding an operating area of the engine 10.

The operation of the engine system according to the second exemplary embodiment of the present invention is the same as that of the first exemplary embodiment as described above, and therefore a detailed description thereof will be omitted.

Further, the intake manifold applied to the engine system according to the second exemplary embodiment of the present invention is the same as that of the first exemplary embodiment as described above, and therefore a detailed description thereof will be omitted.

While this invention has been described in connection with what is presently considered to be practical exemplary embodiments, it is to be understood that the invention is not limited to the disclosed embodiments. On the contrary, it is intended to cover various modifications and equivalent arrangements included within the spirit and scope of the appended claims.

What is claimed is:

1. An intake manifold including a first intake pipe, a second intake pipe, a third intake pipe and a fourth intake pipe respectively connected with a first cylinder, a second cylinder, a third cylinder and a fourth cylinder that are sequentially disposed in an engine, the intake manifold comprising:

a first intake manifold having the second intake pipe, the third intake pipe, and a first surge tank that is configured to temporarily store intake air flowing through an intake line and to distribute the intake air to the second intake pipe and the third intake pipe; and a second intake manifold having the first intake pipe, the fourth intake pipe, and a second surge tank that is configured to temporarily store the intake air flowing through the intake line and to distribute the intake air to the first intake pipe and the fourth intake pipe;

wherein the first cylinder and the fourth cylinder are configured to be selectively deactivated; and wherein an internal volume of the first surge tank is greater than an internal volume of the second surge tank.

2. The intake manifold of claim 1, further comprising a manifold connection valve provided between the first surge tank and the second surge tank, the manifold connection valve configured to selectively open and close a flow passage of the intake air flowing between the first surge tank and the second surge tank.

3. The intake manifold of claim 2, wherein the manifold connection valve includes a valve body forming an intake passage through which the intake air flows, and a flap disposed in the intake passage and configured to selectively open and close the intake passage.

4. The intake manifold of claim 1, further comprising a throttle body having a throttle valve configured to adjust the amount of intake air flowing into the first surge tank from the intake line, wherein the throttle body is mounted in an intake inlet formed in the first surge tank.

5. The intake manifold of claim 1, wherein a recirculation connection hole connected with a recirculation line is formed in the second surge tank.

6. The intake manifold of claim 1, further comprising outer mounting flanges formed in end portions of the first intake pipe and the fourth intake pipe, respectively.

7. The intake manifold of claim 6, further comprising outer engage holes formed on both sides of each of the outer mounting flanges.

8. An engine system comprising:

an engine sequentially provided with a first cylinder, a second cylinder, a third cylinder and a fourth cylinder configured to generate a driving torque by burning fuel;

an intake manifold having a first intake manifold connected with an intake line and configured to distribute intake air to the second cylinder and the third cylinder, and a second intake manifold connected with the first intake manifold configured to distribute the intake air to the first cylinder and the fourth cylinder;

an exhaust manifold having a first exhaust manifold connected with the second cylinder and the third cylinder, and a second exhaust manifold which is connected with the first cylinder and the fourth cylinder;

a recirculation line which is branched off from the second exhaust manifold and merged into the second intake manifold;

a recirculation inlet valve disposed in a portion where the recirculation line and the second exhaust manifold are joined;

wherein the intake manifold includes first, second, third and fourth intake pipes connected with the first, second, third and fourth cylinders, respectively;

wherein the first intake manifold includes the second intake pipe connected with the second cylinder, the third intake pipe connected with the third cylinder, and a first surge tank that is configured to temporarily store the intake air flowing through the intake line and to distribute the intake air to the second intake pipe and the third intake pipe;

wherein the second intake manifold includes the first intake pipe connected with the first cylinder, the fourth intake pipe connected with the fourth cylinder, and a second surge tank that is configured to temporarily store the intake air flowing through the first intake manifold and to distribute the intake air to the first intake pipe and the fourth intake pipe;

wherein the first cylinder and the fourth cylinder are configured to be selectively deactivated; and wherein an internal volume of the first surge tank is greater than an internal volume of the second surge tank.

9. The engine system of claim 8, further comprising a manifold connection valve provided between the first surge tank and the second surge tank, the manifold connection valve configured to selectively open and close a flow passage of the intake air flowing between the first surge tank and the second surge tank.

10. The engine system of claim 9, wherein the manifold connection valve comprises:

a valve body forming an intake passage through which the intake air can flow; and a flap disposed in the intake passage and configured to selectively open and close the intake passage.

11. The engine system of claim 8, further comprising a throttle body having a throttle valve that is configured to adjust amount of intake air flowing into the first surge tank from the intake line, wherein the throttle body is mounted in an intake inlet formed in the first surge tank.

12. The engine system of claim 8, wherein a recirculation connection hole connected with the recirculation line is formed in the second surge tank.

13. The engine system of claim 10, wherein the intake passage of the valve body has a cylinder shape, and the flap has a disk shape.

14. The engine system of claim 10, wherein:

the intake passage is configured to be selectively opened and closed by a rotation of the flap; and the flap is configured to be rotated by a rotation of a rotation shaft connected with a drive motor and operated by a control signal of an engine control unit.

15. An engine system comprising:

an engine sequentially provided with a first cylinder, a second cylinder, a third cylinder and a fourth cylinder for generating a driving torque by burning fuel;

an intake manifold having a first intake manifold connected with an intake line and configured to distribute intake air to the second cylinder and the third cylinder, and a second intake manifold which is connected with the first intake manifold and is configured to distribute the intake air to the first cylinder and the fourth cylinder;

an exhaust manifold having a first exhaust manifold connected with the second cylinder and the third cylinder, and a second exhaust manifold connected with the first cylinder and the fourth cylinder;

a recirculation line which is branched off from the second exhaust manifold and merged into the second intake manifold;

a recirculation inlet valve disposed in a portion where the recirculation line and the second exhaust manifold are joined;

a turbocharger including a turbine that is configured to be rotated by exhaust gas exhausted from the second exhaust manifold and a compressor that is installed on the intake line at an upstream of the first intake manifold and is configured to be rotated together with the turbine; and an electric supercharger disposed in the intake line between the first intake manifold and the compressor, the electric supercharger including a motor and an electric compressor configured to be operated by the motor to supply compressed air to the first, second, third and fourth cylinders;

wherein the intake manifold includes a first intake pipe, a second intake pipe, a third intake pipe and a fourth intake pipe connected with the first to fourth cylinders, respectively;

wherein the first intake manifold includes the second intake pipe connected with the second cylinder, the third intake pipe connected with the third cylinder, and a first surge tank configured to temporarily store the intake air flowing through the intake line and to distribute the intake air to the second intake pipe and the third intake pipe;

wherein the second intake manifold includes the first intake pipe connected with the first cylinder, the fourth intake pipe connected with the fourth cylinder, and a second surge tank configured to temporarily store the intake air flowing through the first intake manifold and to distribute the intake air to the first intake pipe and the fourth intake pipe;

wherein the first cylinder and the fourth cylinder are configured to be selectively deactivated; and wherein an internal volume of the first surge tank is greater than an internal volume of the second surge tank.

16. The engine system of claim 15, further comprising a manifold connection valve provided between the first surge tank and the second surge tank, the manifold connection valve configured to selectively open and close a flow passage of the intake air flowing between the first surge tank and the second surge tank.

17. The engine system of claim 16, wherein the manifold connection valve comprises:

a valve body forming an intake passage through which the intake air can flow; and a flap disposed in the intake passage and configured to selectively open and close the intake passage.

18. The engine system of claim 15, further comprising a throttle body having a throttle valve configured to adjust an amount of intake air flowing into the first surge tank from the intake line, wherein the throttle body is mounted in an intake inlet formed in the first surge tank.

19. The engine system of claim 15, wherein a recirculation connection hole connected with the recirculation line is formed in the second surge tank.

20. The engine system of claim 15, further comprising:

outer mounting flanges formed in end portions of the first intake pipe and the fourth intake pipe, respectively; and outer engage holes formed on both sides of each of the outer mounting flanges.

* * * * *